US007714488B2

(12) United States Patent
Nagasawa et al.

(10) Patent No.: US 7,714,488 B2
(45) Date of Patent: May 11, 2010

(54) PLASMA JET SPARK PLUG AND IGNITION SYSTEM FOR THE SAME

(75) Inventors: Satoshi Nagasawa, Aichi (JP); Katsunori Hagiwara, Mie (JP); Wataru Matsutani, Aichi (JP)

(73) Assignee: NGK Spark Plug. Co., Ltd., Nagoya Aichi (JP)

( * ) Notice: Subject to any disclaimer, the term of this patent is extended or adjusted under 35 U.S.C. 154(b) by 344 days.

(21) Appl. No.: 11/601,111

(22) Filed: Nov. 17, 2006

(65) Prior Publication Data

US 2007/0114898 A1 May 24, 2007

(30) Foreign Application Priority Data

Nov. 22, 2005 (JP) ..... 2005-337562

(51) Int. Cl.
*H01T 13/20* (2006.01)

(52) U.S. Cl. ..... 313/130; 313/143

(58) Field of Classification Search ..... 313/118–145
See application file for complete search history.

(56) References Cited

U.S. PATENT DOCUMENTS 3,911,307 A * 10/1975 Goto et al. ..... 313/143
4,369,756 A 1/1983 Ezoe
4,388,549 A * 6/1983 Bensman ..... 313/138
5,211,142 A * 5/1993 Matthews et al. ..... 123/143 B
5,704,321 A * 1/1998 Suckewer et al. ..... 123/143 B
6,474,321 B1 * 11/2002 Suckewer et al. ..... 123/620

FOREIGN PATENT DOCUMENTS

JP 56085567 A2 7/1981
JP 5698570 A2 8/1981
JP 57015377 A2 1/1982
JP 02072577 A2 3/1990

* cited by examiner

*Primary Examiner*—Nimeshkumar D Patel
*Assistant Examiner*—Christopher M Raabe
(74) *Attorney, Agent, or Firm*—Brinks Hofer Gilson & Lione

(57) ABSTRACT

A plasma jet spark plug provides improved ignitability and durability by forming a part of a spark discharge gap outside the electric discharge space which generates plasma. An ignition system for the plasma jet spark plug is also disclosed. The plasma jet spark plug includes a center electrode, an insulator defining an axial bore which partially surrounds the center electrode, a cavity surrounded by an inner circumferential face of the axial bore which extends from an opening portion of a front end of the axial bore of the insulator and wherein a front end face of the center electrode is formed. A ground electrode is bent towards a front end portion of the insulator.

21 Claims, 3 Drawing Sheets

PLASMA JET SPARK PLUG AND IGNITION SYSTEM FOR THE SAME

BACKGROUND OF THE INVENTION

The present invention relates to a plasma jet spark plug for an internal combustion engine which generates plasma to ignite an air-fuel mixture and to an ignition system for the plasma jet spark plug.

Conventionally, when an internal combustion engine such as automobile engine runs at low load (hereinafter referred to as "low load operation"), such as while starting or during idling, accidental firing due to unstable combustion tends to occur. In response, lowering the mixture ratio of air and fuel (hereinafter referred to as "the A/F ratio") is performed to facilitate smooth ignition and prevent stalling. However, such an adjustment causes excessive fuel consumption. Therefore, improvement in the ignition characteristics of a spark plug, which achieves secure ignition and a stable combustion of the air-fuel mixture despite a high A/F ratio has been demanded.

A plasma jet spark plug is known as a spark plug with high ignitability as disclosed in Laid Open Japanese Patent Application Publication No. S56-98570. As used herein, "ignitability" refers to the ability of a spark plug or plasma jet spark plug to ignite the air-fuel mixture in the cylinder of an internal combustion engine. Such a plasma jet spark plug (igniter plug) includes a small electric discharge space and a circumferential face of a spark discharge gap between a center electrode and a ground electrode which is surrounded by an insulating material such as ceramic. High voltage is applied between the center electrode and the ground electrode in order to generate a spark discharge. The dielectric breakdown caused by the spark discharge causes a current flow at relatively low voltage. Further, the spark discharge transits and generates plasma in the spark discharge space to ignite the air-fuel mixture by supplying energy.

Plasma has a high ignitability and provides stable combustion at low load operation. However, plasma tends to cause an increase in temperature of a spark plug due to its high energy, thereby resulting in a significant wearing of the electrode of the spark plug. Japanese Patent Publication No. S56-98570 also discloses that plasma is generated to ignite the air-fuel mixture at low load operation. On the contrary, only the spark discharge is performed at the time of high load operation (hereinafter referred to as "high load operation"), such as at high speed running of an internal combustion engine, to prevent wearing out of the electrode as well as to improve the ignitability.

However, since a plasma jet spark plug according to the above-noted Japanese patent application has a construction in which a spark discharge gap is surrounded by a face made of an insulating material, a spark discharge ignites an air-fuel mixture, which is included in the spark discharge gap, at high load operation where only an ignition by the spark discharge is performed. Thus, poor ignitability and slow combustion may occur because a flame core cannot be formed in a flow of the air-fuel mixture in a combustion chamber.

The present invention is accomplished in view of the foregoing problems of the prior art and an object of the present invention is to provide a plasma jet spark plug which can improve the ignitability and durability thereof by forming a part of a spark discharge gap in the outside of the electric discharge space which generates plasma. An ignition system for the plasma jet spark plug is also provided.

SUMMARY OF THE INVENTION

A plasma jet spark plug according to a first aspect of the invention comprises: a center electrode, an insulator having a bore extending in an axial direction of the center electrode, accommodating a front end of the center electrode therein and holding the center electrode, a metal shell surrounding the insulator in a radial direction so as to hold the insulator therein, a ground electrode including one end bonded to a front end face of the metal shell and the other end bent towards a front end of the insulator and forming a spark discharge gap with the center electrode, and a cavity forming a discharge space surrounded by an inner circumferential face of said axial bore which extends from an opening portion at a front end of the bore and a front end face of the center electrode, wherein plasma formed in the discharge space is shot out from the opening portion when a spark discharge occurs in the spark discharge gap.

In addition to the construction according to the first aspect of the invention, a plasma jet spark plug according to a second aspect of the invention includes a spark discharge gap comprising: an aerial discharge gap in which a spark is discharged between the other end of the ground electrode and a surface of a front end portion of the insulator, an outer creeping discharge gap in which a spark is discharged between an originating point of the aerial discharge gap on the surface of the front end portion of the insulator and the opening portion along the surface of the insulator and an inner creeping discharge gap in which a spark is discharged between the opening portion and the center electrode along an inner circumferential face of the cavity.

In addition to the construction according to the first or the second aspect of the invention, a plasma jet spark plug according to a third aspect of the invention includes a spark discharge cavity in which the length of the cavity in the axial direction is greater than the inner diameter of the cavity.

Finally, a fourth aspect of the invention is an ignition system which applies voltage to a plasma jet spark plug according to any one of aspects one, two or three, wherein the ignition system comprises: a spark discharge voltage applying means in which voltage is applied to the plasma jet spark plug so as to generate a spark discharge in the spark discharge gap due to a dielectric breakdown, a capacitor which stores energy and supplies energy to the spark discharge gap so that plasma may be formed along with the spark discharge generated by said spark discharge voltage applying means, charging means which charges the capacitor so that plasma may be formed at the time of the spark discharge, switching means which switches on and off an electric connection between the capacitor and the charging means, and control means which controls the switching means, wherein the charging means does not charge the capacitor when the spark discharge voltage applying means generates only the spark discharge and the charging means charges the capacitor when the spark discharge voltage applying means generates spark discharge and the capacitor supplies energy to said spark discharge gap.

Since a plasma jet spark plug according to the first aspect of the invention has a construction such that one end of the ground electrode is bent towards a front end portion of the insulator in which a cavity is included so that plasma may be formed and shot out from an opening portion, a spark may be discharged outside the cavity in a spark discharge gap formed between the ground electrode and a center electrode. That is, since the air-fuel mixture in a combustion chamber can be ignited not only inside the cavity but also outside the cavity, ignitability may be improved compared to the case where the ignition is performed inside the cavity, despite the fact that the ignition is caused by only the spark discharge without plasma. Therefore, in the situation where high ignitability is required, such as while starting an internal combustion engine or while idling, the ignition can be performed by shooting out plasma. On the other hand, in the situation where high ignitability is not required, such as during high speed running of an internal combustion engine, the ignition can be performed by only the spark discharge.

The high energy of a plasma is likely to cause significant overheating and wearing out of an electrode of a plasma jet spark plug. However, when an ignition method is properly used according to the operational status, i.e., low or high speed operation, of an internal combustion engine as mentioned above, the degree of electrode consumption may be minimized, thereby resulting in improved durability of the plasma jet spark plug. Further, because the number of times it is necessary to utilize high energy for forming plasma is reduced, it leads to less consumption of energy resources, such as a battery and an improvement of fuel consumption.

When a spark discharge gap comprises an aerial discharge gap, an outer creeping discharge gap and an inner creeping discharge gap according to the second aspect of the invention, effective ignition of an air-fuel mixture may be achieved by the spark discharged in the aerial discharge gap and the outer creeping discharge gap without forming plasma. Further, despite the fact that a plasma jet spark plug is fouled, the plasma jet spark plug of the present invention can clean the surface of the front end portion of the insulator because high energy plasma may shoot out.

In order to securely form such plasma, the length of the cavity in the axial direction is preferably greater than the inner diameter of the cavity as mentioned in the third aspect of the invention. When the inner diameter of the cavity is equal to or greater than the length (depth) thereof, the shape of the plasma may not be formed like a column of flame, i.e., a flame-like shape. In order to improve ignition, the plasma preferably ignites the air-fuel mixture in a location distant from the insulator or the ground electrode which both cause a flame inhibiting action. For that purpose, plasma is preferably shot out with a flame-like shape.

Further, with an ignition system according to the fourth aspect of the invention, the plasma jet spark plug according to any one of aspects one through three of the invention can be properly and effectively used according to the operational status of the internal combustion engines. Therefore, the durability of the electrode of a plasma jet spark plug may be improved. Furthermore, it is possible to reduce the consumption of energy resources, such as a battery and improve the fuel consumption.

DESCRIPTION OF THE PREFERRED EMBODIMENT

Figure 1:
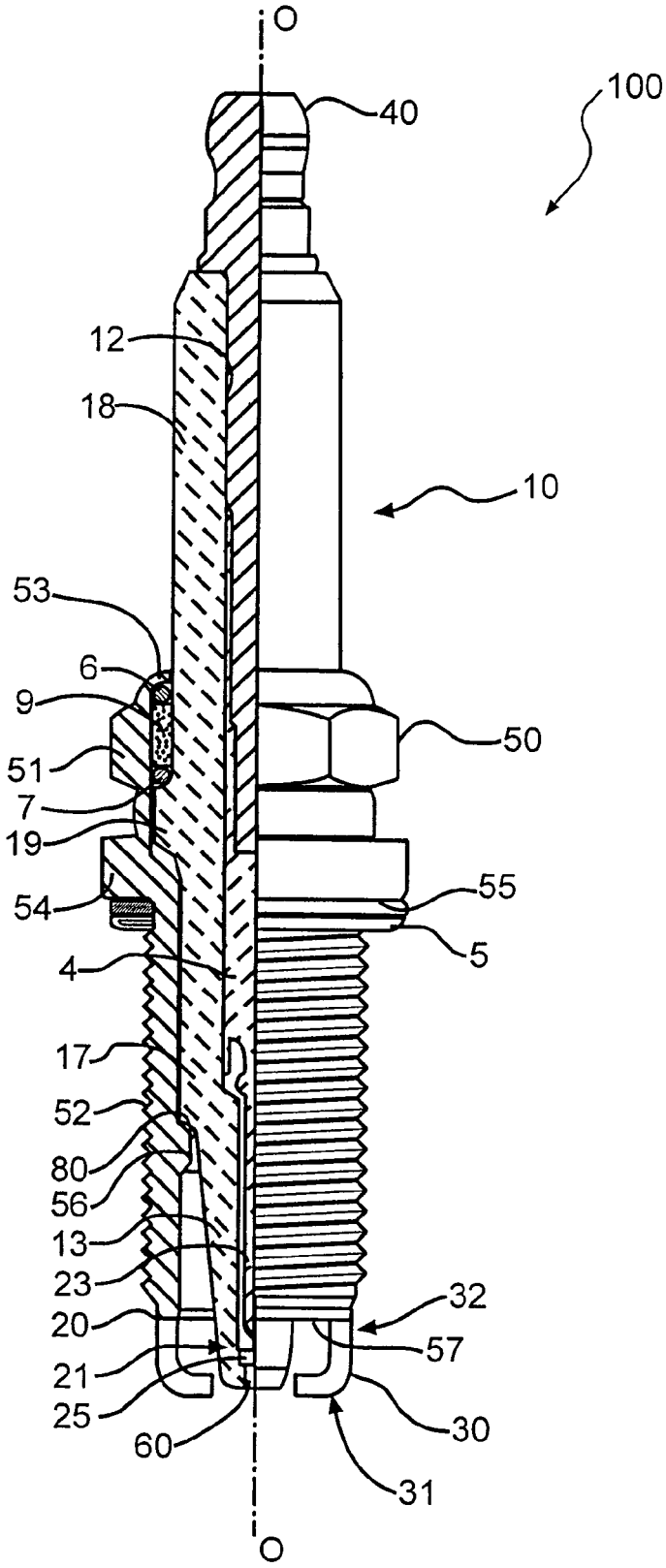
FIG. 1 is a side elevational view in half-section of a plasma jet spark plug according to the present invention.

An embodiment of a plasma jet spark plug embodying the present invention and an ignition system for the plasma jet spark plug will now be described with reference to the drawings. First, referring to FIGS. 1 and 2, a construction of a plasma jet spark plug 100 according to the present invention will be explained. In FIG. 1, the direction of axis "O" of the plasma jet spark plug 100 is regarded as the top-to-bottom direction in the drawing. A lower portion of the drawing is regarded as a front end of the plasma jet spark plug 100 and an upper portion of the drawing is regarded as a back end of the plasma jet spark plug 100.

As shown in FIG. 1, the plasma jet spark plug 100 includes an insulator 10, a metal shell 50 holding the insulator 10 therein, a center electrode 20 held in the insulator 10 in the direction of the axis "O", two pieces of ground electrode 30 each having a base portion 32 welded to a front end face 57 of the metal shell 50, wherein a front end portion 31 of the ground electrode is bent towards a peripheral face of a front end portion 11 of the insulator 10 and a terminal metal shell 40 is provided at a back end portion of the insulator 10.

The insulator 10 is a tubular insulating member including an axial hole or bore 12 in the axis "O" direction, which is formed by sintering alumina or the like as is commonly known. A flange portion 19 having the largest outer diameter is formed almost at the center in the axis "O" direction and a back end body portion 18 is formed at the back end therefrom. A front end body portion 17 having a smaller outer diameter than that of the back end body portion 18 is formed near the front end from the flange portion 19. A long leg portion 13 having a smaller outside diameter than that of the front end body portion 17 is formed nearer the front end from the front end body portion 17. The diameter of the long leg portion 13 gradually becomes smaller toward the front end, and the long leg portion 13 is exposed to the combustion chamber when the plasma jet spark plug 100 is assembled in an internal combustion engine (not shown). An area formed between the long leg portion 13 and the front end body portion 17 assumes a step form.

Figure 2:
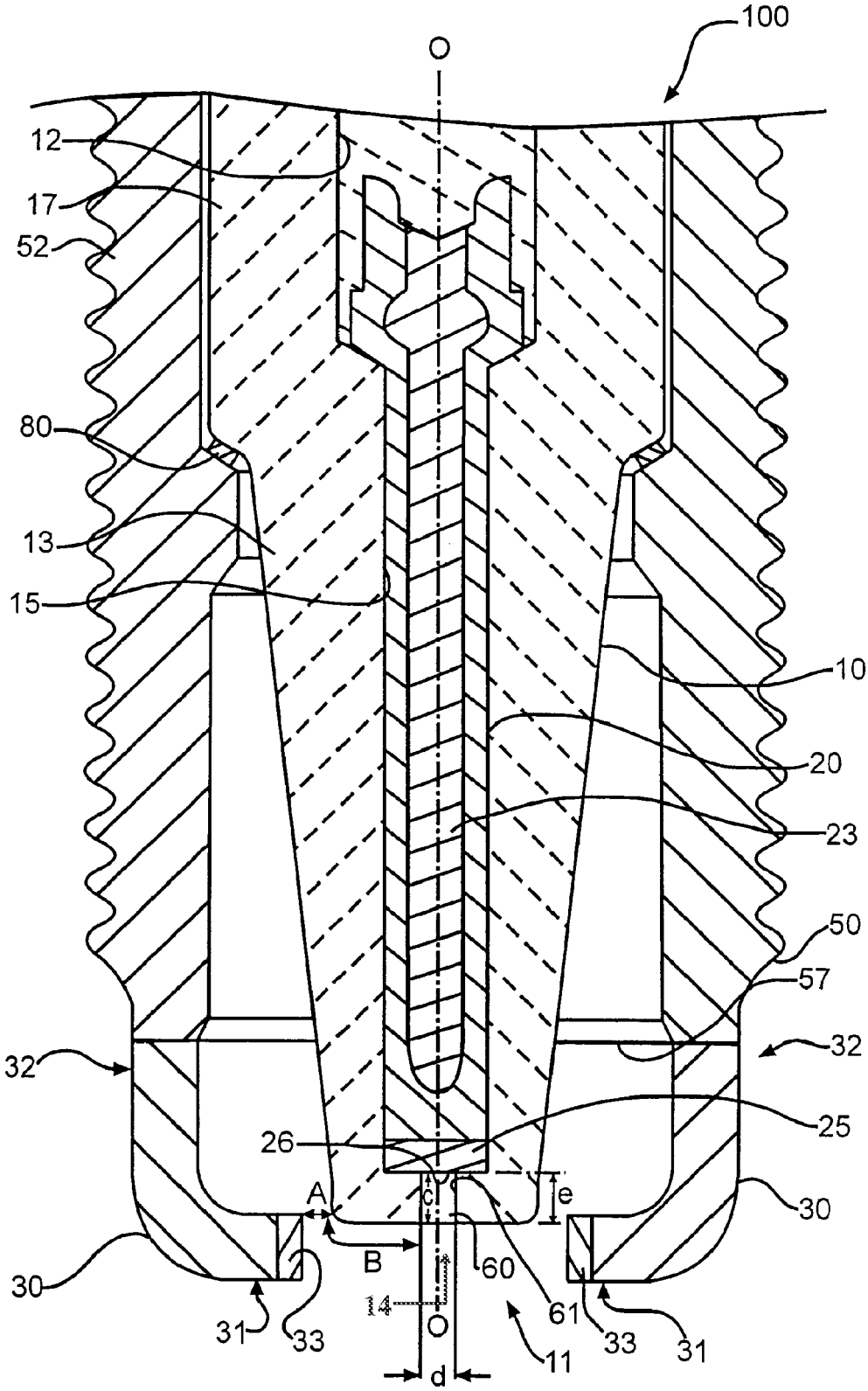
FIG. 2 is a fragmentary, full sectional view of an enlarged front end portion of a plasma jet spark plug according to the present invention.

As shown in FIG. 2, the axial hole or bore 12 of the insulator 10 is formed so as to have a reduced diameter portion 15 at the long leg portion 13 and hold the center electrode 20 therein. A part of the axial hole 12, which extends to an opening portion 14 of the front end of the axial hole 12, has a further reduced diameter than that of the reduced diameter portion 15. In this part, a discharge space defined by an inner circumferential face of the axial hole or bore 12 (serving as an inner circumferential face 61 of a cavity 60 later described) and a front end face of the front end portion 21 of the center electrode 20, i.e., a front end face 26 of an electrode tip 25 which is integrally bonded to the center electrode 20 at the front end portion 21 of the center electrode 20, is provided. This space serves as a cavity 60 where plasma is formed and shot out from the opening portion 14. The cavity 60 is formed so that the depth thereof, i.e., the length in the axis "O" direction (length "e" shown in FIG. 2) may be longer than the inner diameter of the cavity 60 (inner diameter "d" shown in FIG. 2).

The center electrode 20 is a rod-shaped electrode comprising nickel-system alloys or the like such as Inconel® 600 or 601 in which a metal core 23 comprising copper or the like with excellent thermal conductivity is provided. Inconel is a registered trademark of Huntington Alloys Corporation of Huntington, W. Va. A disk-shaped electrode tip 25 comprising a noble metal is welded to the front end portion 21 so as to integrate it with the center electrode 20. Suitable noble metals include platinum, rhodium and tantalum. As mentioned above, the center electrode 20 is accommodated in the reduced diameter portion 15 of the axial hole or bore 12 while exposing the electrode tip 25 to the cavity 60. The diameter of the back end of the center electrode 20 is expanded like a flange shape, and this flange portion is located in contact with a step portion that extends to the reduced diameter portion 15 of the axial hole or bore 12.

As shown in FIG. 1, the center electrode 20 is electrically connected to a terminal or metal fitting 40 at the back end through a conductive sealing body 4 provided inside the axial hole or bore 12 which is made from a mixture of metal and glass. The sealing body 4 is employed to electrically connect the center electrode 20 and the terminal or metal fitting 40 and fix them in the axial hole or bore 12. A high tension cable (not shown) is connected to the terminal or metal fitting 40 through a plug cap (not shown), to which high voltage is applied by an ignition system 200 (illustrated in FIG. 3) which will be described subsequently.

Next, the ground electrode 30 shown in FIG. 2 comprises a metal having excellent corrosion resistance. As one of the examples, a nickel-system alloy such as Inconel® 600 or 601 is used. The ground electrode 30 has a generally rectangular cross-section in its longitudinal direction and one end (base portion 32) is welded to the front end face 57 of the metal shell 50. The other end (front end portion 31) of the ground electrode 30 is bent towards the front end portion 11 of the insulator 10. According to this embodiment, two ground electrodes 30 are provided and are disposed in the symmetrical position centering on the position of axis "O." An electrode tip 33 comprising a noble metal is bonded to the front end portion 31 of the ground electrodes 30, respectively, so as to be integrated therewith.

The metal shell 50 shown in FIG. 1 is a tubular metal fitting which surrounds and holds the insulator 10 to fix the plasma jet spark plug 100 to an engine head of the internal combustion engine. The metal shell 50 comprises an iron system material and includes a tool engagement flats 51 to which a plasma jet spark plug wrench (not shown) is fit and a screw or threaded portion 52 which screws into a cylinder head of the internal combustion engine.

Annular ring members 6, 7 are interposed between the tool engagement flats 51 and a caulking portion 53 of the metal shell 50 and the back end body portions 18 of the insulator 10. Further, talc powder 9 is filled between both ring members 6, 7. The caulking portion 53 is formed at the back end of the tool engagement flats 51, and the insulator 10 is pushed toward the front end in the metal shell 50 through the ring members 6, 7 and the talc 9 by caulking the caulking portion 53. Thus, a step portion between the front end body portion 17 and the long leg portion 13 is supported by a step portion 56 formed in the inner periphery of the metal shell 50 through an annular packing 80. As a result, the metal shell 50 and the insulator 10 are integrated. Airtightness between the metal shell 50 and the insulator 10 is maintained by the packing 80, which prevents combustion gas from flowing past. A flange portion 54 is formed between the tool engagement flats 51 and the screw portion 52, and a gasket 5 is inserted and fitted in the vicinity of the back end of the screw portion 52, that is, on a seat surface 55 of the flange portion 54.

In the plasma jet spark plug 100 according to this embodiment, a spark discharge gap formed between the ground electrode 30 and the center electrode 20 includes three discharge gaps, i.e., an aerial discharge gap, an outer creeping discharge gap and an inner creeping discharge gap. The aerial discharge gap is located where a dielectric breakdown occurs between the electrode tip 33 of the front end portion 31 of the ground electrode 30 and the front end portion 11 of the insulator 10, which is indicated by an arrow "A" in FIG. 2. A spark is discharged from an originating point of the aerial discharge gap at the insulator 10 side, i.e., a location on an outer circumferential face of the front end portion 11 where the spark discharge occurs between the front end portion 31 of the ground electrode 30 and the center electrode 20 through the opening portion 14 along the surface of the insulator 10. The outer creeping discharge gap is the location where the spark is discharged outside the cavity 60, that is, along the outer surface of the front end portion 11 of the insulator 10 (referred to as arrow "B" in FIG. 2). The inner creeping discharge gap is the location where the spark is discharged along the inner circumferential face 61 of the cavity 60 (referred to as arrow "C" in FIG. 2).

Next, with reference to FIG. 3, one example of the construction of the ignition system 200 that generates and controls the application of high voltage to the plasma jet spark plug 100 according to the above embodiment will be described.

The ignition system 200 includes a spark discharge circuit portion 210 which comprises a capacitive discharge ignition or CDI type power supply circuit. The spark discharge circuit portion 210 is electrically connected to the center electrode 20 of the plasma jet spark plug 100 through a diode 201 for preventing reverse current flow. The spark discharge circuit portion 210 is controlled by a controlling circuit portion 220 connected to an ECU (electronic control unit) in an automobile or other motor vehicle. The spark discharge circuit portion 210 is a power circuit portion for performing a so-called "trigger discharge" which causes a dielectric breakdown by applying a high voltage (e.g., −20 kV) to the spark discharge gap and produces a spark discharge. In this embodiment, the direction of potential and the direction of the diode 201 in the spark discharge circuit portion 210 are established so that current may flow into the center electrode 20 from the ground electrode 30 during the trigger discharge. The spark discharge circuit portion 210 is equivalent to a "spark discharge voltage applying means" in the present invention.

Further, the ignition system 200 includes a plasma discharge circuit portion 230 which is controlled by a controlling circuit portion 240 connected to the ECU (electronic control unit) of an automobile. The plasma discharge circuit portion 230 is also connected to the center electrode 20 of the plasma jet spark plug 100 through a diode 202 for preventing current backflow. The plasma discharge circuit portion 230 is a power circuit portion for supplying high energy to the spark discharge gap where the dielectric breakdown is caused by the trigger electric discharge performed by the spark discharge circuit portion 210 and producing the plasma.

The plasma discharge circuit portion 230 includes a capacitor 231 for storing electric charge. One end of the capacitor 231 is grounded and the other end is electrically connected to the center electrode 20 through the diode 202. Further, a high voltage generation circuit 233 which generates the high voltage (e.g., −500V) of negative polarity is connected to the other end of capacitor 231 so that electric charge may be stored by the capacitor 231. Further, the high voltage generation circuit 233 is connected to the controlling circuit portion 240 so as to be able to control the output electric power based on a signal from the controlling circuit portion part 240. Similarly to the above, in this embodiment, when the energy for generating plasma is supplied to the spark discharge gap from the capacitor 231, the direction of potential and the direction of the diode 202 in the high voltage generation circuit 233 are established so that current may flow into the center electrode 20 from the ground electrode 30. It is noted that the controlling circuit portion part 240 is equivalent to a "switching means control means" in the present invention and the high voltage generation circuit 233 which switches output electric power based on the signal from the controlling circuit portion part 240 is equivalent to a "switching means" in the present invention. Furthermore, the high voltage generation circuit 233 charges the capacitor 231 according to the output electric power, and is equivalent to a "charging means" in the present invention.

In addition, the ground electrode 30 of the plasma jet spark plug 100 is grounded through the metal shell 50 as shown in FIG. 1.

Next, operation of the plasma jet spark plug 100 connected to the ignition system 200 for igniting the air-fuel mixture will be explained. The ignition system 200 controls the discharge operation of the plasma jet spark plug 100. For example, at high load operation, such as at high speed operation of the internal combustion engine, only a spark discharge generated by a trigger electric discharge is implemented in the spark discharge gap. On the other hand, at low load operation, such as during starting of the internal combustion engine or during idling operation, the plasma, which is formed along with the trigger discharge, is shot out.

Figure 3:
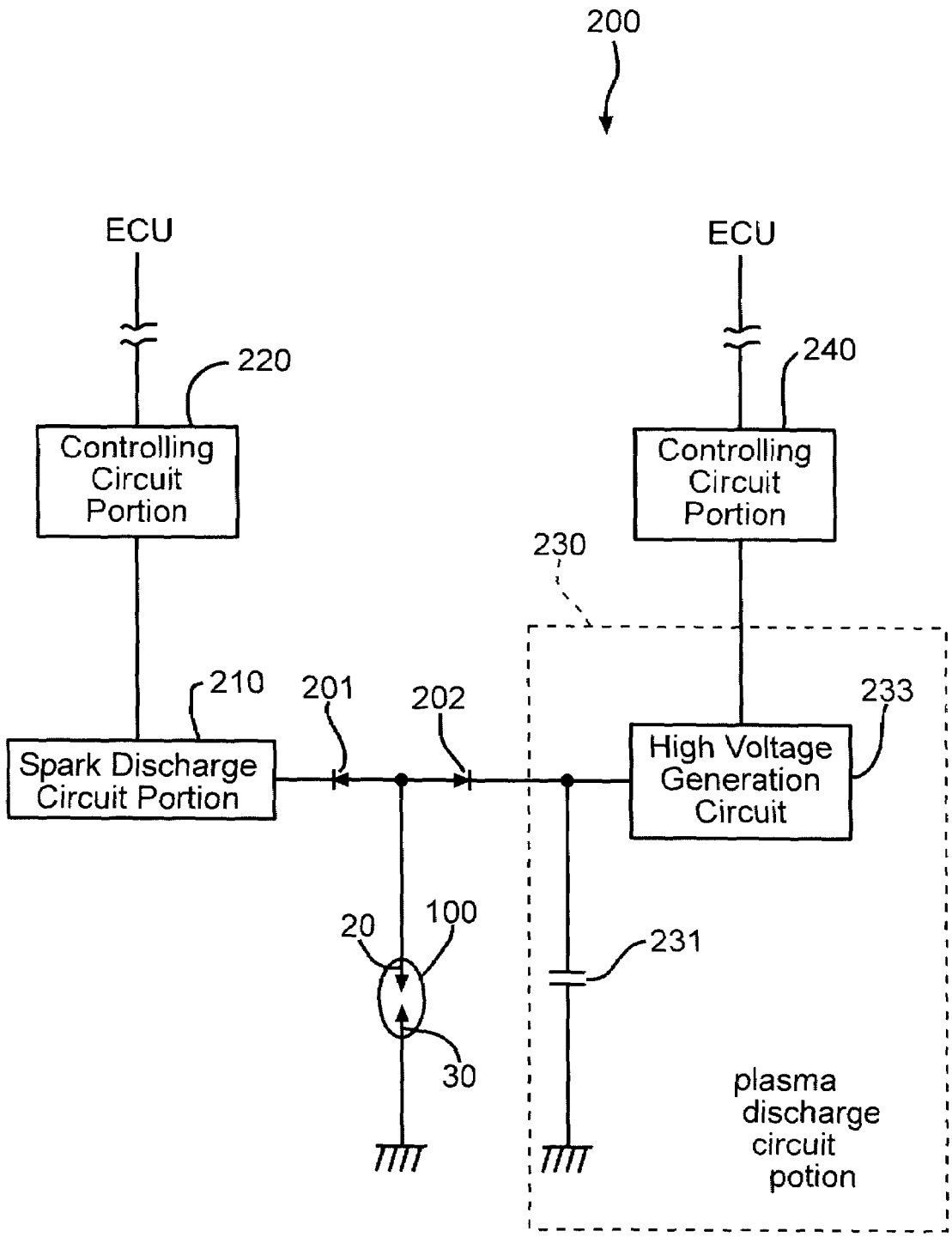
FIG. 3 is a schematic view of an electrical circuit configuration of an ignition system according to the present invention.

When the controlling circuit portion 240 shown in FIG. 3 receives the operational information from the ECU, which indicates the low load operation, the high voltage generation circuit 233 outputs the power. Before achieving dielectric breakdown in the spark discharge gap, the capacitor 231 is charged by a closed loop formed by the capacitor 231 and the high voltage generation circuit 233 because current backflow is prevented by the diodes 201, 202.

When the controlling circuit portion 220 receives the information, which indicates ignition timing, from the ECU, the controlling circuit portion 220 controls the spark discharge circuit portion 210 so that the high voltage may be applied to the plasma jet spark plug 100. With this operation, the insulation between the ground electrode 30 and the center electrode 20 is destroyed, thereby generating the trigger discharge. As shown in FIG. 2, the spark discharge generated at this time destroys the insulation produced by the air between the front end portion 31 of the ground electrode 30 (the electrode tip 33) and the front end portion 11 of the insulator 10 (the aerial discharge gap A). Then, the spark is discharged towards the cavity 60 along the outer surface of the front end portion 11 from the originating point of electric discharge at the front end portion 11 (the outer creeping discharge gap B). Subsequently, the spark is discharged towards the front end portion 21 of the center electrode 20 (the electrode tip 25) along the inner circumferential face 61 of the cavity 60 (the inner creeping discharge gap C).

When, the insulation of the spark discharge gap is destroyed by the trigger discharge, current can be fed to the spark discharge gap with a relatively low voltage. Therefore, the energy stored in the capacitor 231 is released and supplied to the spark discharge gap. Thus, plasma with high energy is generated in the small space cavity 60 surrounded by the wall. Because the inner diameter "d" of the cavity 60 is shorter than the length "e" of the cavity 60, the shape of the plasma is like a column of flame, i.e., a flame-like shape. The flame shoots out from the opening portion 14 of the front end portion 11 of the insulator 10 towards the outside, i.e., towards the combustion chamber. Then, the flame ignites the air-fuel mixture in the combustion chamber and the flame core grows therein so as to achieve combustion.

When the diameter "d" of the cavity 60 is equal to or longer than the length "e" of the cavity 60, the plasma may not be shaped like a flame. In order to improve the ignition, the plasma preferably assumes the flame shape and ignites the air-fuel mixture in a location distant from the insulator 10 or the ground electrode 30 which both cause a flame inhibiting action. For that purpose, the diameter "d" of the cavity 60 is preferably less than the length "e" of the cavity 60.

On the other hand, when the controlling circuit portion 240 shown in FIG. 3 receives the operational information, which indicates the high load operation, from the ECU, no output is sent from the high voltage generation circuit 233. Because the capacitor 231 is not charged, only the trigger discharge will be performed at the above-mentioned ignition timing. As mentioned above, although this spark discharge runs through the aerial discharge gap A, the outer creeping discharge gap B and the inner creeping discharge gap C, the air-fuel mixture present about the circumference of the front end portion 11 of the insulator 10 is ignited by the spark discharge, thereby being capable of combusting the air-fuel mixture.

It goes without saying that all kinds of modifications are possible in the present invention. For example, although the spark discharge circuit portion 210 employs a publicly known capacity electric discharge type (CDI) ignition circuit, other ignition methods, such as a full transistor type or a point type can also be employed.

For convenience, although the controlling circuit portion 220 and the controlling circuit portion 240 are constituted as an individual body, they may be integrated and the communication to the ECU may also be united. Alternatively, the ECU can directly control the spark discharge circuit portion 210 and the plasma discharge circuit portion 230.

Further, although two pieces of ground electrodes 30 are provided in this embodiment, the number of ground electrodes 30 may be only one or may be three or more.

Furthermore, current flows into the center electrode 20 from the ground electrode 30 in the present invention, however, the power supply or the circuit composition can be constituted such that current flows into the ground electrode 30 from the center electrode 20 by reversing the polarity. In detail, the high voltage generated from the high voltage generation circuit 233 is treated as a positive terminal, and the orientation of the diodes 201, 202 may be reversed. It is noted that the electrode tip 25 bonded to the center electrode 20 is relatively smaller than the electrode tip 33 of the ground electrode 30 in the construction. Therefore, current preferably flows into the ground electrode 30 from the center electrode 20 when considering the wearing out of the electrode of the center electrode 20 side.

The foregoing disclosure is the best mode devised by the inventors for practicing this invention. It is apparent, however, that devices incorporating modifications and variations will be obvious to one skilled in the art of plasma jet spark plugs and ignition systems. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. A plasma jet spark plug, comprising:

a center electrode having a center electrode front end;

an insulator having an insulator front end and an axial bore accommodating and holding said center electrode, said axial bore extending to an opening portion at said insulator front end, said insulator front end defining an outer circumferential surface;

a metal shell having a shell front end and receiving and partially surrounding said insulator;

a ground electrode having a first ground electrode end bonded to said shell front end and a second ground electrode end disposed proximate said insulator front end and forming a spark discharge gap with said center electrode front end, said spark discharge gap including an aerial discharge gap in which a spark is discharged between said second ground electrode end and said outer circumferential surface of said insulator front end, said aerial discharge gap being located where a dielectric breakdown occurs between said second ground electrode end and said outer circumferential surface of said insulator front end; and a discharge cavity defined by an inner circumferential surface of a portion of said insulator, said inner circumferential surface extending from said center electrode front end to said opening portion;

wherein plasma formed in said discharge cavity is shot out from said opening portion when a spark discharge occurs in said spark discharge gap.

2. A plasma jet spark plug according to claim 1, wherein said spark discharge gap further comprises:

an outer creeping discharge gap in which a spark is discharged outside the discharge cavity between an originating point of said aerial discharge gap on the outer circumferential surface of said insulator front end and said opening portion along the outer circumferential surface of said insulator; and an inner creeping discharge gap in which a spark is discharged between said opening portion and said center electrode along said inner circumferential surface.

3. A plasma jet spark plug according to claim 1, wherein the length of said discharge cavity in the axial direction is longer than the inner diameter of said discharge cavity.

4. A plasma jet spark plug according to claim 2, wherein the length of said discharge cavity in the axial direction is longer than the inner diameter of said discharge cavity.

5. An ignition system for applying voltage to the plasma jet spark plug of claim 1, wherein said ignition system comprises:

spark discharge voltage applying means in which voltage is applied to said plasma jet spark plug to generate a spark discharge in said spark discharge gap due to the dielectric breakdown;

a capacitor which stores and supplies energy to said spark discharge gap to form plasma along with said spark discharge generated by said spark discharge voltage applying means;

charging means which charges said capacitor to form a plasma at the time of said spark discharge;

switching means which switches an electric connection between said capacitor and said charging means on and off; and control means which controls said switching means, wherein said charging means does not charge said capacitor when said spark discharge voltage applying means generates only the spark discharge, and wherein said charging means charges said capacitor when said spark discharge voltage applying means generates spark discharge and said capacitor supplies energy to said spark discharge gap.

6. An ignition system for applying voltage to the plasma jet spark plug of claim 2, wherein said ignition system comprises:

spark discharge voltage applying means in which voltage is applied to said plasma jet spark plug to generate a spark discharge in said spark discharge gap due to the dielectric breakdown;

a capacitor which stores and supplies energy to said spark discharge gap to form plasma along with said spark discharge generated by said spark discharge voltage applying means;

charging means which charges said capacitor to form a plasma at the time of said spark discharge;

switching means which switches an electric connection between said capacitor and said charging means on and off; and control means which controls said switching means, wherein said charging means does not charge said capacitor when said spark discharge voltage applying means generates only the spark discharge, and wherein said charging means charges said capacitor when said spark discharge voltage applying means generates spark discharge and said capacitor supplies energy to said spark discharge gap.

7. An ignition system for applying voltage to the plasma jet spark plug of claim 3, wherein said ignition system comprises:

spark discharge voltage applying means in which voltage is applied to said plasma jet spark plug to generate a spark discharge in said spark discharge gap due to the dielectric breakdown;

a capacitor which stores and supplies energy to said spark discharge gap to form plasma along with said spark discharge generated by said spark discharge voltage applying means;

charging means which charges said capacitor to form a plasma at the time of said spark discharge;

switching means which switches an electric connection between said capacitor and said charging means on and off; and control means which controls said switching means, wherein said charging means does not charge said capacitor when said spark discharge voltage applying means generates only the spark discharge, and wherein said charging means charges said capacitor when said spark discharge voltage applying means generates spark discharge and said capacitor supplies energy to said spark discharge gap.

8. A plasma jet spark plug according to claim 1, wherein the diameter of said discharge cavity is less than the diameter of said center electrode.

9. A plasma jet spark plug, comprising:

a center electrode having a center electrode front end;

an insulator extending beyond said center electrode front end, said insulator having an insulator front end and an axial bore accommodating and holding said center electrode, said axial bore extending to an opening portion at said insulator front end, said insulator front end defining an outer circumferential surface;

a metal shell having a shell front end and receiving and partially surrounding said insulator;

a ground electrode having a first ground electrode end bonded to said shell front end and a second ground electrode end disposed proximate said insulator front end and forming a spark discharge gap with said center electrode front end the second ground electrode end being spaced laterally away from said outer circumferential surface of said insulator front end to define an aerial discharge gap; and a discharge cavity defined by an inner circumferential surface of a portion of said insulator, said discharge cavity extending longitudinally beyond said center electrode front end;

wherein plasma formed in said discharge cavity is shot out from said opening portion when a spark discharge occurs in said spark discharge gap.

10. A plasma jet spark plug according to claim 9, wherein said spark discharge gap includes said aerial discharge gap in which a spark is discharged between the second ground electrode end and a surface of a front end portion of said insulator, said spark discharge gap further comprising:

an outer creeping discharge gap in which a spark is discharged outside the discharge cavity between an originating point of said aerial discharge gap on the outer circumferential surface of said insulator front end and said opening portion along the outer circumferential surface of said insulator; and an inner creeping discharge gap in which a spark is discharged between said opening portion and said center electrode along said inner circumferential surface.

11. A plasma jet spark plug according to claim 9, wherein the length of said discharge cavity in the axial direction is longer than the inner diameter of said discharge cavity.

12. A plasma jet spark plug according to claim 9, wherein the diameter of said discharge is less than the diameter of said center electrode.

13. A plasma jet spark plug according to claim 9, wherein said insulator wraps around a portion of said center electrode front end.

14. A plasma jet spark plug according to claim 9, wherein said insulator substantially covers said center electrode front end.

15. An ignition system for the plasma jet spark plug according to claim 9, the ignition system comprising:

a spark discharge circuit portion having spark discharge voltage applying means for applying voltage to the plasma jet spark plug to generate said spark discharge in said spark discharge gap due to the dielectric breakdown;

a plasma discharge circuit portion having a capacitor for storing energy and for supplying energy to said spark discharge gap so that plasma may be formed along with said spark discharge generated by said spark discharge voltage applying means;

charging means for charging said capacitor so that plasma may be formed at the time of said spark discharge, switching means for switching an electric connection between said capacitor and said charging means on and off; and a control circuit portion for controlling a switch of said switching means, wherein said ignition system is configured such that said spark discharge circuit portion and said plasma discharge circuit portion are connected in parallel to the plasma jet spark plug.

16. The ignition system according to claim 15, wherein said control circuit portion controls said switching means based on operational information obtained from an external control unit, and wherein said switching means switches to a first mode for charging said capacitor by way of said charging means and to a second mode for not charging the capacitor by way of said charging means.

17. An ignition system for a plasma jet spark plug, the plasma jet spark plug comprising:

a center electrode having a center electrode front end;

an insulator wrapping around a portion of said center electrode front end, said insulator having an insulator front end and an axial bore accommodating and holding said center electrode, said axial bore extending to an opening portion at said insulator front end;

a metal shell having a shell front end and receiving and partially surrounding said insulator;

a ground electrode having a first ground electrode end bonded to said shell front end and a second ground electrode end disposed proximate said insulator front end and forming a spark discharge gap with said center electrode front end; and a discharge cavity defined by an inner circumferential surface of a portion of said insulator such that plasma formed in said discharge cavity is shot out from said opening portion when a spark discharge occurs in said spark discharge gap;

wherein the ignition system comprises:

a spark discharge circuit portion having spark discharge voltage applying means for applying voltage to the plasma jet spark plug to generate said spark discharge in said spark discharge gap due to a dielectric breakdown;

a plasma discharge circuit portion having a capacitor for storing energy and for supplying energy to said spark discharge gap so that plasma may be formed along with said spark discharge generated by said spark discharge voltage applying means;

charging means for charging said capacitor so that plasma may be formed at the time of said spark discharge, switching means for switching an electric connection between said capacitor and said charging means on and off; and a control circuit portion controlling said switching means based on operational information obtained from an external control unit, said control circuit portion controlling said switching means by way of a switch;

said switching means switching between a first mode for charging said capacitor by way of said charging means and a second mode for not charging the capacitor by way of said charging means, and the ignition system being configured such that said spark discharge circuit portion and said plasma discharge circuit portion are connected in parallel to the plasma jet spark plug.

18. An ignition system according to claim 17, wherein said operational information is at least indicative of an engine load.

19. An ignition system according to claim 18, wherein said controlling circuit is configured to signal said switching means to switch to the first mode when said operational information indicates low engine load operation.

20. An ignition system according to claim 18, wherein said controlling circuit is configured to signal said switching means to switch to the second mode when said operational information indicates high engine load operation.

21. The ignition system for the plasma jet spark plug of claim 17, wherein the length of said discharge cavity in the axial direction is longer than the inner diameter of said discharge cavity, and wherein said spark discharge gap comprises:

an aerial discharge gap in which a spark is discharged between the second ground electrode end and a surface of a front end portion of said insulator;

an outer creeping discharge gap in which a spark is discharged between an originating point of said aerial discharge gap on the surface of said insulator front end and said opening portion along the surface of said insulator; and an inner creeping discharge gap in which a spark is discharged between said opening portion and said center electrode along said inner circumferential surface.

* * * * *